United States Patent [19]

Fukuroi et al.

[11] Patent Number: 4,639,983

[45] Date of Patent: Feb. 3, 1987

[54] HOOK FOR A HOOK-AND-EYE FASTENER

[75] Inventors: Takeo Fukuroi; Keichi Inazawa, both of Uozu, Japan

[73] Assignee: Nippon Notion Kogyo Co., Ltd., Tokyo, Japan

[21] Appl. No.: 747,958

[22] Filed: Jun. 24, 1985

[30] Foreign Application Priority Data

Jul. 6, 1984 [JP] Japan ..... 59-102169

[51] Int. Cl.[4] ..... A44B 1/42

[52] U.S. Cl. ..... 24/689; 24/101 B; 24/690; 24/698

[58] Field of Search ..... 24/689, 690, 698, 695, 24/599, 101 B; 403/232.1

[56] References Cited

U.S. PATENT DOCUMENTS

| | | | |
|---|---|---|---|
| 783,807 | 2/1905 | Tuteur | 403/232.1 |
| 1,266,219 | 5/1918 | Curtiss | 24/695 |
| 1,993,734 | 3/1935 | Edelheit | 24/689 |
| 2,941,271 | 6/1960 | Rocca | 24/689 |
| 2,961,728 | 11/1960 | Cohn | 24/689 |
| 2,998,627 | 9/1961 | Wood | 24/689 |
| 3,069,740 | 12/1962 | Heil | 24/689 |
| 3,283,382 | 11/1966 | Wood et al. | 24/689 |
| 3,443,290 | 5/1969 | Cohn | 24/689 |
| 3,908,237 | 9/1975 | Cruse | 24/689 |
| 4,521,943 | 6/1985 | Kanzaka | 24/689 |

FOREIGN PATENT DOCUMENTS

| | | | |
|---|---|---|---|
| 602512 | 3/1960 | Italy | 24/690 |
| 821459 | 10/1959 | United Kingdom . | |

*Primary Examiner*—Victor N. Sakran

*Attorney, Agent, or Firm*—Hill, Van Santen, Steadman & Simpson

[57] ABSTRACT

A hook for a hook-and-eye fastener includes a one-piece hook body having at least one pair of prongs, and a retainer having openings through which the prongs extend, respectively. The hook body includes a locking tongue and a base underlying the locking tongue, and an arcuate portion joining the locking tongue and the base, the prongs projecting substantially perpendicularly from the base in a direction away from the locking tongue. The hook body has a plurality of cold-pressed elongated recesses defined in an inner surface of the hook body and extending from the base through the arcuate portion to the locking tongue, thereby giving resilience and strength that are large enough to withstand forces tending to permanently deform the hook body at the arcuate portion. The openings in the retainer are spaced from one another by a distance which is larger than the distance between the prongs. Each of the prongs has a bent end portion retained on the retainer with a space defined therebetween. With the hook thus constructed, the hook body is tiltable with respect to the retainer, thereby accomodating the thrust applied thereto during, for instance, the ironing of a garment fabric to which the hook is attached.

6 Claims, 10 Drawing Figures

HOOK FOR A HOOK-AND-EYE FASTENER

BACKGROUND OF THE INVENTION

1. Field of the Invention

The present invention relates to a hook for a hook-and-eye fastener for fastening together two pieces of a garment such as a trouser or a skirt.

2. Prior Art

Known hooks for hook-and-eye fasteners generally include a hook body having a plurality of prongs on a hook base that penetrate a garment fabric and have bent end portions retained on a retainer for attaching the hook to the garment fabric. The hook body further has a locking tongue lying substantially parallel to the base and an intermediate bent portion extending between the base and the locking tongue. This hook body is relatively weak and hence is likely to be crushed or permanently deformed at the bent portion when subjected to a force tending to compress the base and the locking tongue during, for instance, the ironing of the garment fabric. With the hook body thus crushed, a smooth insertion of the locking tongue into the companion loop or eye is difficult to achieve.

One attempt made heretofore to overcome the foregoing drawback is disclosed in British Patent No. 821459, wherein a hook body has a plurality of elongated reinforcing ribs projecting on the outer surface of the hook body and extending from a base through a bent portion to a locking tongue, there being defined in the inner surface of the hook body a corresponding number of grooves complementary in contour to the projections. The disclosed hook body having such outwardly projecting ribs is defective from an aesthetic view and rough to touch. Further, since the ribs and the grooves are formed by stamping, the hook body is likely to be damaged or broken at the bent portion due to cracks created during the formation of the ribs and grooves.

SUMMARY OF THE INVENTION

It is therefore an object of the present invention to provide a hook for a hook-and-eye fastener which is strong enough to withstand forces tending to crush or permanently deform the hook at an arcuately bent portion thereof.

Another object of the present invention is to provide a hood for a hook-and-eye fastener which is sightly in appearance and smooth to touch.

According to the invention, a hook for a hook-and-eye fastener includes a one-piece hook body having a locking tongue and a base underlying the locking tongue, and an arcuate portion joining the locking tongue and the base, the base having a pair of prongs projecting substantially perpendicularly therefrom in a direction away from the locking tongue. The hook body has a plurality of cold-pressed elongated recesses extending from the base through the arcuate portion to the locking tongue, thereby giving resilience and strength that are large enough to withstand forces tending to permanently deform the hook body at the arcuate portion. The recesses are defined in an inner surface of the hook body which is concealed from the view so that the hook body is sightly in appearance and smooth to touch. The hook also includes a retainer having a pair of openings through which prongs on the base extend. The openings are spaced from each other by a distance which is larger than the distance between the prongs. Each of the prongs has a bent end portion retained on the retainer with a space defined therebetween. With the hook thus constructed, the hook body is tiltable with respect to the retainer, thereby accomodating the thrust applied thereto during, for instance, the ironing of a garment fabric to which the hook is attached.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION

Figure 1:
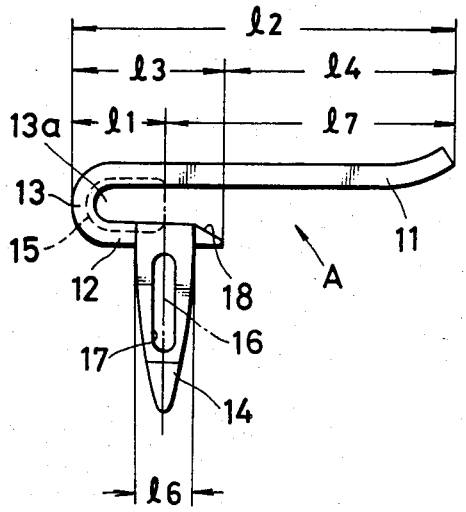
FIG. 1 is a front elevational view of a hook body of a hook according to the present invention.
Figure 2:
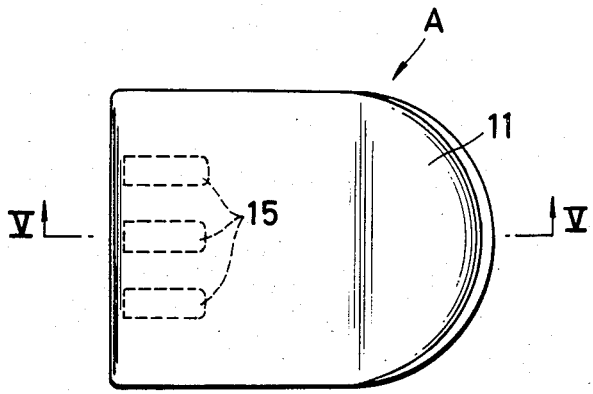
FIG. 2 is a plan view of the hook body shown in FIG. 1.
Figure 3:
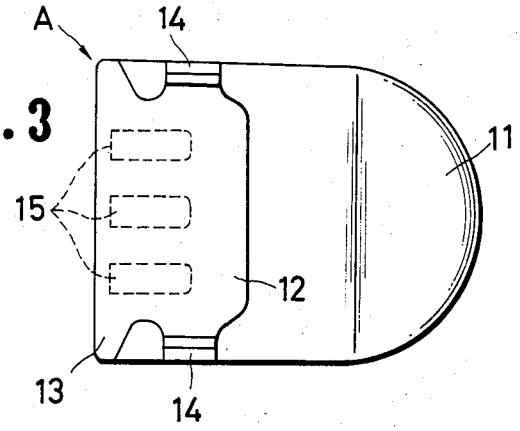
FIG. 3 is a bottom view of FIG. 2.
Figure 4:
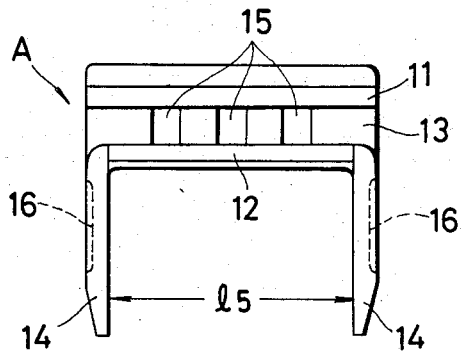
FIG. 4 is a right side elevational view of the hook body.

FIGS. 1 through 5 show a hook body A of a hook for a hook-and-eye fastener for fastening together two pieces of a garment. The hook body A is press-formed from sheet metal and includes an upper locking tongue 11, a lower base 12 lying substantially parallel to the locking tongue 11, and an intermediate arcuate portion 13 extending between the locking tongue 11 and the base 12 for defining therebetween an eye-receiving channel 13*a* for receiving a portion of the companion loop or eye of the hook-and-eye fastener. A pair of prongs 14, 14 is disposed on opposite edges of the base 12 and projects substantially perpendicularly therefrom in a direction away from the locking tongue 11.

Figure 5:
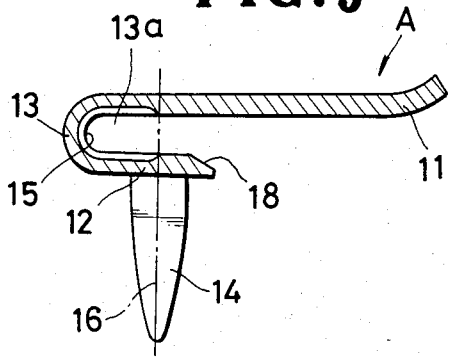
FIG. 5 is a cross-sectional view taken along line V—V of FIG. 2.

The hook body A further has a plurality of elongated receses 15 (three in the illustrated embodiment) formed by cold pressing and extending from the base 12 through the arcuate portion 13 to the locking tongue 11. The cold-pressed elongated recesses 15 are defined in an inner surface of the hook body A facing the eye-receiving channel 13*a*. As best shown in FIG. 5, each of the recesses 15 has opposite end portions progressively reducing in depth and terminating in a plane in which the longitudinal central axes 16 of the prongs 14 extend. The hook body A is thus of a high cold pressed modulus in a region adjacent to the elongated recesses 15 for facilitating the bending of the blank of the hook body and at the same time affording increased resilience and strength to the arcuate portion 13. Since the recesses 15 are formed by cold pressing, the hook body A is free from cracks which would be created in a comparative prior hook body having stamped ribs. The number of the grooves 15 is not limited to three as shown in the illustrated embodiment. Further, the outer surface of the hook body A is neither ribbed nor grooved so that the hook body A as a whole is sightly in appearance and smooth to touch.

As shown in FIG. 1, the prongs 14 are located such that the longitudinal central axes 16 of the prongs 14 extend in a plane which is spaced from the vertex of the arcuate portion by a distance 11 substantially equal to one-fourth of the entire length 12 of the hook body A, the length 12 corresponding to the distance between the vertex of the arcuate portion 13 and the free end of the locking tongue 11. Each of the prongs 14 has in its outer side surface an elongated recess 17 formed by cold pressing and extending along the longitudinal central axis 16 of the prong 14 so that a region adjacent to the recess 17 is harder than the other region of the prong 14. Although not shown, the base 12 may has an additional prong located at one of the free end or the proximal end of the base 12.

The free end of the base 12 has a sloped guide surface 18 facing away from the arcuate portion 13 to provide a wide entrance for the companion eye to be introduced into the eye-recessing channel 13*a*. In the illustrated embodiment, the sloped guide surface 18 is formed by chamfering the free end of the base 12. Such guide surface may be formed by bending the free end of the base 12 in a direction away from the locking tongue 11. The locking tongue 11 projects beyond the free end of the base 12 by a distance 14 which is one and half times to two times as large as the distance 13 between the vertex of the arcuate portion 13 and the free end of the base 12.

Figure 6:
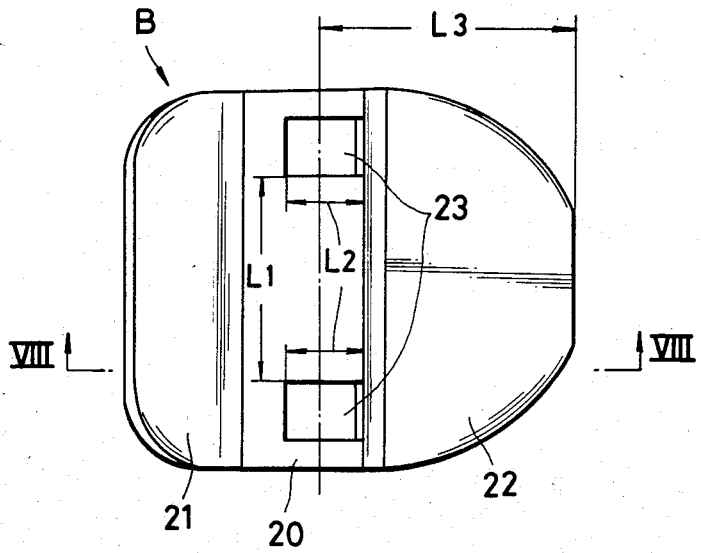
FIG. 6 is a plan view of a retainer of the hook according to the present invention.
Figure 7:
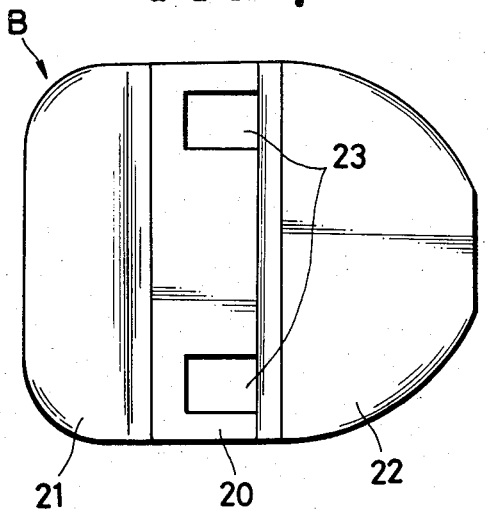
FIG. 7 is a bottom view of FIG. 6.
Figure 8:
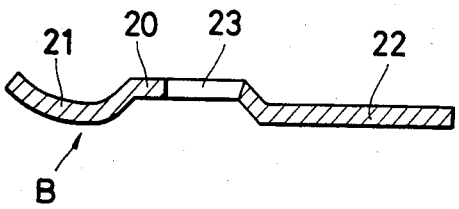
FIG. 8 is a cross-sectional view taken along line VIII—VIII of FIG. 6

As shown in FIGS. 6–8, an oblong retainer B is press-formed from sheet metal and includes a central raised portion 20 extending throughout the width of the retainer 20, an upwardly bent rear portion 21 extending rearwardly from the central raised portion 20, and a flat front portion 22 extending forwardly from the central raised portion 20. As shown in FIG. 8, the bent rear portion 21 has a bottom surface lying flush with the bottom surface of the flat front portion 22, and a free end lying flush with the top surface of the central raised portion 20.

The retainer has a pair of transversely spaced rectangular openings 23, 23 defined in the central raised portion 20 for receiving the prongs 14, 14, respectively. The openings 23, 23 are spaced from one another by a distance L1 (FIG. 6) which is larger than the distance 15 (FIG. 4) between the prongs 14, 14. Each of the rectangular openings 23 has a width or an extent L2 (FIG. 6) in the longitudinal direction of the retainer B, which extent L2 is larger than,the width 16 (FIG. 1) of the prongs 14. Further, the free end of the flat front portion 22 is spaced from a central line of the openings 23 by a distance L3 (FIG. 6) which is smaller than the distance 17 (FIG. 1) between the free end of the locking tongue 11 and the plane in which the longitudinal central axes 16 of the prongs 14, 14 lie.

Figure 9:
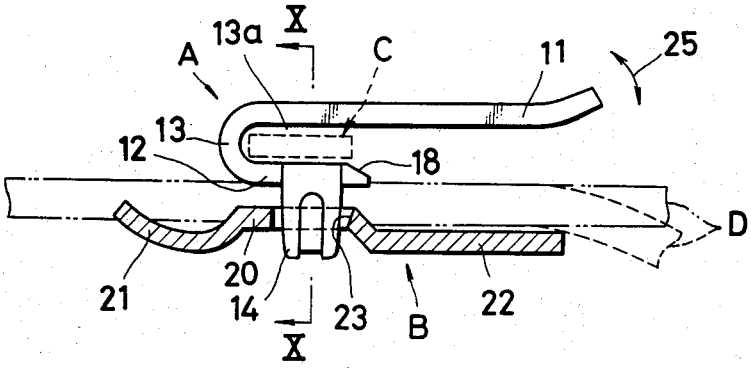
FIG. 9 is a front elevational view, partly in cross section, of an assembled hook.
Figure 10:
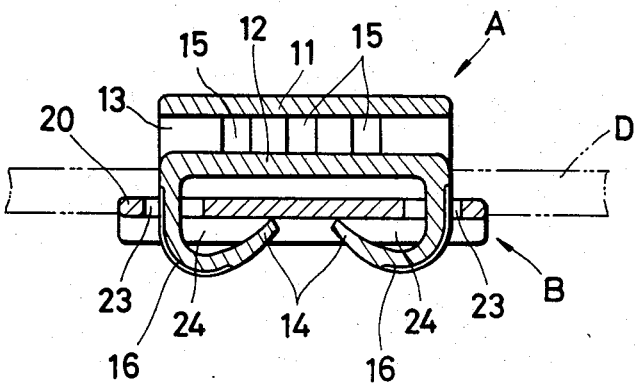
FIG. 10 is a cross-sectional view taken along line X—X of FIG. 9.

The hook body A and the retainer B are assembled together into a clinched condition as shown in FIGS. 9 and 10. For assembling, the prongs 14, 14 of the hook body A penetrate a garment fabric D and extend through the openings 23, 23 in the retainer B. Then, end portions of the prongs 14 are deformed by a punch-and-die unit (not shown) into inwardly axially bent ends until respective distal ends engage the retainer B with spaces 24 (FIG. 10) defined between the bent end portions and the retainer B. The hook body A and the retainer B thus attached together with the garment fabric D disposed therebetween, constitute a hook engageable with a loop or eye C (FIG. 9) attached to another garment fabric, not shown. In this assembled condition, the free end of the upwardly bent rear portion 21 and the central raised portion 20 bite into the garment fabric D to prevent any relative movement between the retainer B and the garment fabric D. Partly because of the distance 15 (FIG. 4) greater than the distance L1 (FIG. 6), and partly because of the clearances 24, the hook body A is tiltable about the distal ends of the prongs 14 in the directions indicated by the arrowheads 25 in FIG. 9. Furthermore, since the width L2 of the openings 23 is larger than the width of the prongs 14, the hook body A is movable in a plane parallel to the retainer B. Such relative movement between the hook body A and the retainer and the increased resiliency and strength of the arcuate portion 13 jointly serve to take up or accomodate forces tending to depress the locking tongue 11 toward the retainer B, thereby preventing the hook body A from being crushed or permanently deformed at the arcuate portion 13.

Another advantage of the hook lies in that the prongs 14 are located near the arcuate portion 13; the distance 11 between the vertex of the arcuate portion 13 and the axes 16 of the prongs 14 approximately equal to one-fourth of the entire length 12 of the hook body A. The smallness of the distance 11 enables the upwardly bent rear portion 21 to be reduced in length, providing a large area for sewing threads running along edges of the garment fabric D. Furthermore, the locking tongue 11 projects beyond the distal end of the flat front portion 22 of the retainer B so that a relatively large entrance to the eye-receiving channel 13*a* can be provided between the free end of the locking tongue 11 and the garment fabric D when the latter is bent downwardly over the free end of the flat front portion 22 as indicated by broken lines in FIG. 9. Thus, when the hook body A and the eye C are brought into interlocking engagement with each other, a portion of the eye C can easily be introduced from such wide entrance into a space between the locking tongue 11 and the garment fabric D, and thence it is introduced into the eye-receiving channel 13*a*. During that time, the sloped guide surface 18 allows a smooth insertion of the portion of the eye C into the channel 13*a*.

Although various minor modifications may be suggested by those versed in the art, it should be understood that we wish to embody within the scope of the patent warranted hereon, all such embodiments are reasonably and properly come within the scope of our contribution to the art.

What is claimed is:

1. A hook for a hook-and-eye fastener, comprising:

(a) a one-piece hook body including a base, a locking tongue lying substantially parallel to said base, an intermediate arcuate portion extending between said base and said locking tongue so as to define therebetween an eye-receiving channel, said locking tongue projecting beyond the free end of said base by a distance which is one and a half to two times as large as a distance between the vertex of said arcuate portion and the free end of said base, said base having a pair of prongs projecting substantially perpendicularly therefrom in a direction away from said locking tongue, said prongs being located on opposite edges of said base such that the longitudinal central axes of said prongs extend in a plane which is spaced from the vertex of said arcuate portion by a distance approximately equal to one-fourth of the entire length of said hook body;

(b) said hook body having an inner surface facing said eye-receiving channel, and a plurality of cold-pressed elongated recesses defined in said inner surface and extending from said base through said arcuate portion to said locking tongue, each said recess having opposite end portions terminating adjacent to a plane in which the longitudinal central axes of said prongs extend, a region adjacent said recesses having a cold-pressed modulus large enough to afford increased resiliency and strength to said arcuate portion; and (c) a retainer having a pair of openings through which said prongs can extend, respectively, said openings being spaced from one another by a distance which is smaller than the distance between said pair of prongs, each said prong having a bent end portion retained on said retainer with a space defined therebetween.

2. A hook according to claim 1, each said recess having opposite end portions progressively reducing in depth.

3. A hook according to claim 1, said base having a free end and a sloped guide surface on said free end facing in a direction away from said arcuate portion.

4. A hook according to claim 1, said retainer having one end terminating short of a free end of said locking tongue.

5. A hook according to claim 1, each said opening having a width larger than the width of said prongs.

6. A hook according to claim 1, said bent end portions being curved inwardly axially arcuately toward each other, each said prong having in its outer surface a cold-pressed elongate recess extending longitudinally along a corresponding one of said bent end portions, a region adjacent to said cold-pressed recess being harder than the other region of said prong.

* * * * *